US011482080B1

(12) United States Patent
Rolfs et al.

(10) Patent No.: US 11,482,080 B1
(45) Date of Patent: Oct. 25, 2022

(54) LOTTERY TICKET DISPENSING METHOD AND SYSTEM WITH ADDITIONAL PURCHASE RECOMMENDATION CAPABILITY

(71) Applicant: Scientific Games International, Inc., Newark, DE (US)

(72) Inventors: Susan Emily Rolfs, Waxhaw, NC (US); Todd George Stover, Canton, GA (US); Jacob Ezra Kreider, Harrisburg, PA (US); Richard Colin DiCroce, Berkley, MA (US); Kent D. Christensen, Cumming, GA (US)

(73) Assignee: Scientific Games, LLC, Alpharetta, GA (US)

( * ) Notice: Subject to any disclaimer, the term of this patent is extended or adjusted under 35 U.S.C. 154(b) by 0 days.

(21) Appl. No.: 17/328,404

(22) Filed: May 24, 2021

(51) Int. Cl.
*G07F 17/32* (2006.01)
*G07F 17/42* (2006.01)
*G07F 9/02* (2006.01)

(52) U.S. Cl.
CPC ..... *G07F 17/329* (2013.01); *G07F 9/026* (2013.01); *G07F 17/3237* (2013.01); *G07F 17/42* (2013.01)

(58) Field of Classification Search
CPC ..... G07F 17/329; G07F 9/026; G07F 17/42; G07F 17/3237
See application file for complete search history.

(56) References Cited

U.S. PATENT DOCUMENTS 6,397,193 B1 * 5/2002 Walker ..... G07F 17/3248 705/16
7,479,060 B2 1/2009 Walker et al.
8,602,863 B2 12/2013 Walker et al.
11,276,273 B1 * 3/2022 Donahue, III ..... G07F 17/323
2005/0194735 A1 * 9/2005 Mirandette ..... A63F 3/0665 273/138.1
2006/0241966 A1 * 10/2006 Walker ..... G06Q 30/0237 700/232
2006/0261546 A1 * 11/2006 Payne ..... A63F 3/0605 273/139
2016/0232741 A1 * 8/2016 Assis ..... G07F 17/3211

* cited by examiner

*Primary Examiner* — David L Lewis
*Assistant Examiner* — Robert E Mosser
(74) *Attorney, Agent, or Firm* — Dority & Manning, P.A.

(57) ABSTRACT

A lottery ticket dispensing method provides an inventory of lottery tickets in an automated dispenser, the inventory comprising lottery tickets for a plurality of different lottery games. Upon a player making a selection of a lottery ticket from the dispenser, with a controller in communication with the dispenser, one or more companion lottery games for the lottery ticket selected by the player are assigned from the different lottery games in the inventory based on predefined filter values. The method verifies that the designated companion lottery games have lottery tickets available in the inventory and then presents one or more of the verified designated companion lottery games to the player as a suggestion or recommendation for an additional lottery ticket purchase.

19 Claims, 5 Drawing Sheets

LOTTERY TICKET DISPENSING METHOD AND SYSTEM WITH ADDITIONAL PURCHASE RECOMMENDATION CAPABILITY

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including automated electronic dispensers that automatically dispense a ticket from a bin or compartment upon receipt of an electronic command signal. These dispensers may be configured as self-serve vending dispensers wholly operated by the purchaser or clerk-operated dispensers located at a point of sale in the retail establishment. These dispensers are particularly beneficial in that they have enabled a broad and varied spectrum of different lottery games to be displayed and dispensed to players from a single machine.

The concept of automatically providing a potential purchaser with recommendations for purchase of one or more additional, related products based on the purchaser's particular selected product has become a well-established practice, particularly in the field of internet-based commerce. This sales practice can potentially generate significant increased sales for the vendor while being quite gratifying for the purchaser.

It would be a benefit to the lottery industry, particularly to the government-based lottery sponsors or providers who rely on lottery revenue for various projects, to incorporate the above-defined sales practice with the sale of lottery tickets via multi-bin automated dispensers in an efficient and reliable manner.

The present invention is directed to a system and method for dispensing lottery tickets from a dispenser, which may be an automated dispenser, with an additional purchase recommendation or suggestion to the player of one or more additional tickets that might be of interest the player.

SUMMARY

Objects and advantages of the invention will be set forth in part in the following description, or may be obvious from the description, or may be learned through practice of the invention.

In accordance with aspects of the invention, a lottery ticket dispensing method is enabled that includes providing an inventory of lottery tickets in a dispenser, which may be configured as an automated electronic dispenser, wherein the inventory includes lottery tickets for a plurality of different lottery games. For example, the lottery tickets may be scratch-off lottery tickets wherein each game may have a different game theme, rules of play, prize structure, and the like. Each of the different lottery games has at least one companion lottery game associated therewith designated from the different lottery games in the inventory based on one or more predefined filter values. Upon a player making a selection of a lottery ticket from the automated dispenser, the method includes designating one or more of the companion lottery games assigned to the lottery game associated with the lottery ticket selected by the player. The method includes verifying that the designated companion lottery games have lottery tickets available in the inventory. One or more of the verified, designated companion lottery games are assigned to the player's selection and then presented to the player, for example via a video display or interactive screen at the dispenser, as a suggestion or recommendation for an additional lottery ticket purchase. The player can add the additional purchase to the purchase process used for their initial lottery ticket selection, which is processed by the dispenser controller.

An embodiment of an automated electronic dispenser used to implement the method may vary within the scope of the invention. In one embodiment, the dispenser may be configured as a self-serve dispenser (e.g., a lottery ticket vending machine) operated by the player for purchase of lottery tickets. In another embodiment, the dispenser may be configured as an automated dispenser operated by a clerk at the retail location upon request by the player for purchase of lottery tickets.

Embodiments of the method may further include conducting an inventory tally of the lottery tickets for each of the different lottery games that may be offered as companion lottery games. In one embodiment, a decision engine (controller) determines one or more recommended companion lottery games and delivers this decision to the dispenser, which in turn determines if lottery tickets for the recommended game(s) are in inventory in the dispenser.

In an alternate embodiment, the decision engine is kept up to date on the lottery tickets in the dispenser and makes its recommendation decision based on the lottery tickets that are known to be in inventory in the dispenser. This process would rely on a continuous or periodic inventory process of the lottery tickets in the dispenser that is communicated to the decision engine. For example, the method may include conducting an inventory tally of the lottery tickets for each of the different lottery games according to a defined schedule, wherein the verifying step includes subtracting a known number of dispense sequences of the lottery tickets for the designated companion lottery games up to that point in time (either from the initial loading of the tickets or from a previously determined inventory tally) from the tally.

As the inventory changes with new or replacement lottery tickets, the assignment of companion lottery tickets is adjusted accordingly. The assignment of companion lottery games may be revised upon changing out one or more of the lottery games in the dispenser with a different lottery game or upon adding an additional lottery game in the dispenser.

The predefined filter values may be one or a combination of fixed filter values based at least in part on predetermined commonalities or relationships between the different lottery games in the inventory or variable filter values that change based on external real-world situational data. In one example, when a player makes an initial lottery ticket choice, that choice is evaluated against all of the filter values at that point in time. The other games that are available as potential companion lottery games earn "points" or credit for every filter value that applies at that moment. The decision tree implemented by the controller(s) then designates the potential companion lottery games based on a descending points order, skipping any games not having tickets available in the dispenser inventory, until the desired number of companion lottery game recommendations can be made.

For example, for the fixed filter values, a commonality between certain of the lottery games may be a sports theme, a card-game theme, a movie theme, a music theme, and so forth. The commonality may include a certain prize structure or price of each game play (price of the lottery ticket). For example, lottery tickets having a greater prize value (and thus greater purchase price) may be assigned as companion lottery games for each other. These predefined filter values may be stored in a database that is accessed by the decision engine controller. The controller may be the dispenser controller or a central lottery controller that is in communication with the dispenser controller, or a combination of both controllers.

The variable filter values may be based on real-world conditions or events. For example, such variable filter values may relate to the time of year or seasons (e.g., a holiday season), current events, geographic location of the dispenser (e.g., local sports teams), and so forth. If used, these variable filter values may be periodically changed.

A weighting method may be used by the controller when assigning the points to the potential companion lottery games. For example, more or less consideration (points) may be given to the variable filter values as compared to the fixed filter values.

In a particular embodiment, the method may further include consideration of personal data related to the player when designating the companion lottery games, such as the player's age, hobbies, favorite sport teams, favorite movies/music/books, history of prior lottery ticket purchases, or virtually any type of personal information that may influence the player's selection of a lottery game. The personal data related to the player may be stored in an electronic player profile that is accessed upon the player inputting an identification number or code (inclusive of any type of identification data) into the automated dispenser, for example via an interactive screen, display, keyboard, and the like.

The player's personal data may be used to further define or narrow the designated companion lottery games presented to the player. For example, three or four of the different lottery games may be designated as companion lottery games, wherein the personal data (if used) is used to narrow this group to one or two designated companion lottery games.

A different embodiment involves using player personal data as an initial filter value for designating the companion lottery games. Upon identification of a player, the method may include accessing stored electronic personal data of the player. With the decision controller, the personal data of the player is used as one (or the only one) of the filter values to designate one or more companion lottery games from the different lottery games in the inventory. As with the other embodiments, the method verifies that the designated companion lottery games have lottery tickets available in the inventory. Then, one or more of the verified designated companion lottery games is assigned to the player's initial ticket choice and presented to the player as a suggestion for an additional lottery ticket purchase. The player can add the additional purchase to the purchase process used for their initial ticket selection, which is process by the dispenser controller.

As discussed above, the personal data of the player may include, for example, the player's age, biometric data, hobbies, favorite sport teams, favorite movies/music/books, past lottery ticket purchases, or virtually any type of personal information that may influence the player's selection of a lottery game. The personal data related to the player may be stored in an electronic player profile that is accessed upon the player inputting an identification number or code (inclusive of any type of identification data) into the automated dispenser, for example via an interactive screen, display, keyboard, and the like.

The player's personal data may be the only filter value or a heavily weighted filter value. The method may further include inputting additional predefined filter values into the determination of the designated companion lottery games presented to the player, wherein the predefined filter values are one or a combination of fixed filter values based on predetermined commonalities between the different lottery games in the inventory or variable filter values based on real-world external situational data, as discussed above.

The present invention also encompasses a lottery ticket dispensing system configured for execution of the method embodiments discussed above.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

The method embodiments in accordance with the invention are drawn to dispensing lottery tickets from automated lottery ticket dispensers. The methods are not limited to the type of lottery tickets. For example, the lottery tickets may be related to draw-type lottery games and are printed "on demand" at the dispensers. In a particular embodiment described herein, the lottery tickets are pre-printed scratch-off lottery tickets well-known in the industry.

The methods are not limited by the type of automated dispenser, and a number of known conventional dispensers may be configured for practice of the methods. For purposes of explaining aspects of the invention, exemplary automated dispensers are depicted with reference to FIGS. 1-3.

Figure 1:
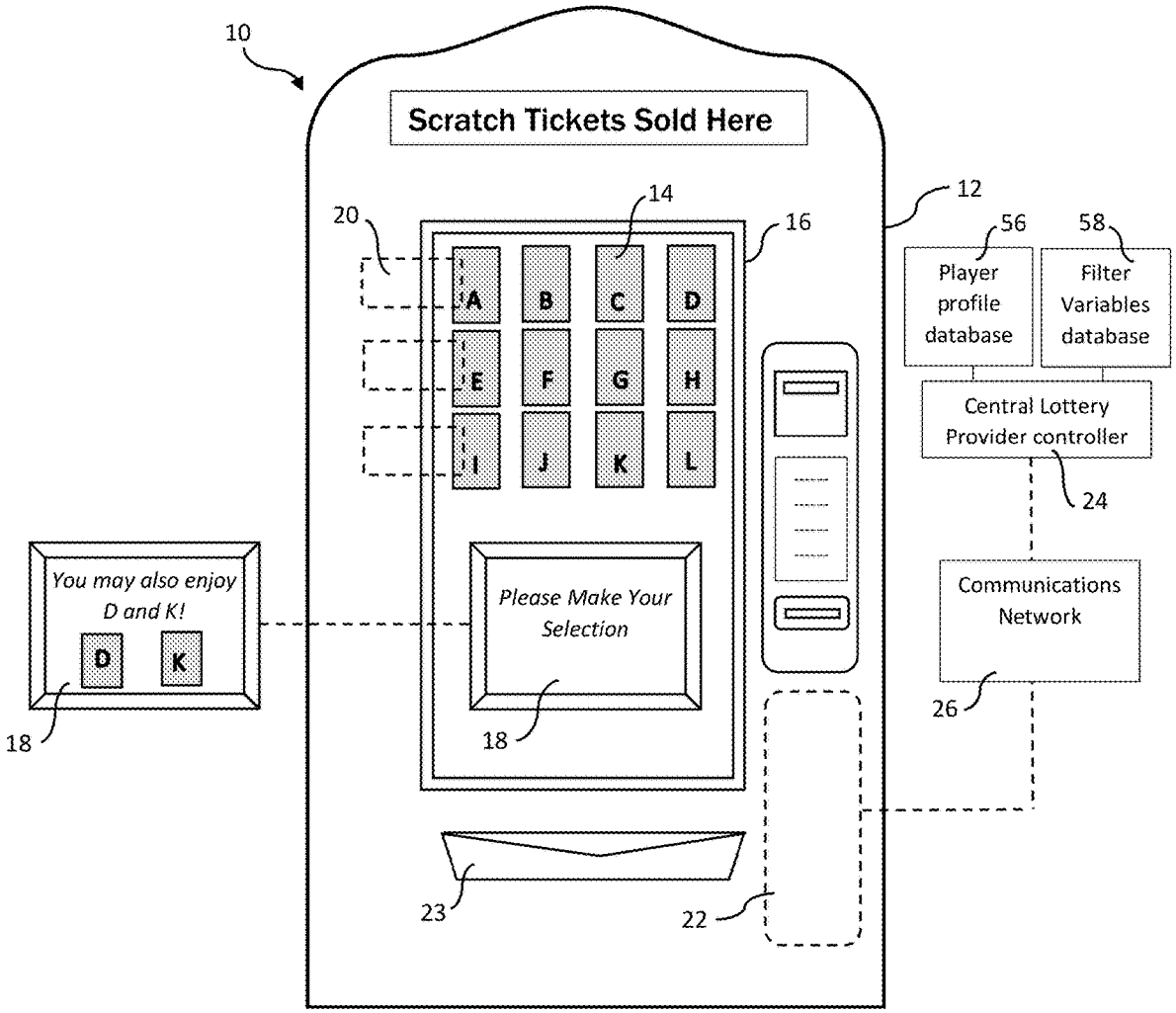
FIG. 1 is a view of an example of an automated lottery ticket dispenser configured for practice of the methods described herein.

FIG. 1 depicts and automated lottery ticket dispenser 10 in the form of a self-serve vending machine wherein potential players can initiate and complete a purchase transaction for one or more lottery tickets 14 contained in the dispenser 10. The dispenser 10 includes a cabinet 12 that houses a plurality of ticket dispensing bins 20 (described in greater detail below). The cabinet 12 may include a front electronic display panel 16 that presents pictures or other representations of the lottery tickets 14 that are available for purchase. Alternatively, the panel may comprise a window that permits viewing of the dispensing bins 20, wherein each bin 20 displays an actual lottery ticket 14.

The dispenser 10 may include an interactive screen 18 or other device (e.g., keyboard) configured to allow the player to make a selection of a ticket 14 for purchase and complete other aspects of the purchase process. Upon completion of the transaction, the bin or bins 20 automatically dispense the purchased lottery tickets, which drop into the tray 23 for retrieval by the player.

The dispenser 10 includes a local controller 22, which may be internal to the cabinet 12. The controller 22 is configured to carry out certain of the dispenser-related processes described herein. The controller 22 may be configured in communication with a remote central lottery controller/server 24 via a suitable communications network 26.

Figure 2:
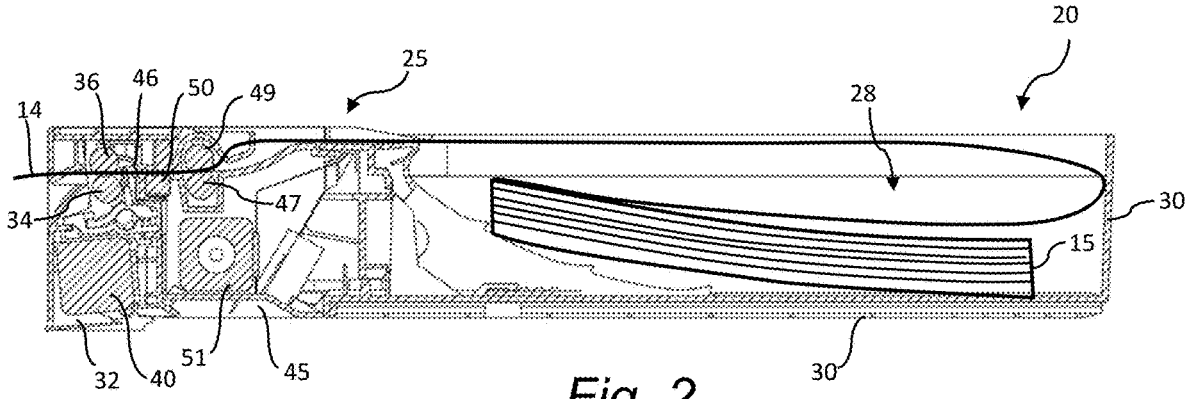
FIG. 2 is a side cut-away view of an exemplary dispensing bin for use in an automated lottery ticket dispenser.

FIG. 2 depicts an embodiment of a bin 20 that may be used in the dispenser 10. A plurality of such bins 20 may be configured in a stacked arrangement within a frame within the cabinet 12, wherein each bin 20 contains a stack 15 of scratch-off lottery tickets 14. Each of the bins 20 includes a controller that is in communication with the dispenser controller 22 for dispensing the lottery tickets 14 purchased by the player.

Referring still to FIG. 2, the bin 20 includes one or more ticket compartments 28 formed by bottom and side walls 30. The ticket compartment 28 may have an open top for easier insertion of the lottery tickets 14 therein. The lottery tickets 14 (e.g., scratch-off lottery tickets) are provided in a roll or fan-folded stack 15 and are connected in an end-to-end strip at a separation line, such as a perforation line, between adjacent tickets. Each lottery ticket 14 in the stack 15 typically includes a machine-readable code printed on a front or back side thereof, such as an alpha-numeric code, bar code, QR code, or the like. The type of code may vary depending on the desired information content of the code, space on the ticket 14, and so forth. The use of such codes on lottery tickets 14 for various functions related to inventory, identification, verification, and security are well-known.

In the illustrated embodiment, bin 20 includes an automated dispensing mechanism 25, which may be variously configured. For example, the dispensing mechanism 25 may include a separation module 32 through which the continuous strip of lottery tickets 14 from the ticket compartment 28 is threaded and a leading lottery ticket 14 is separated and dispensed from the bin 20. The separation module 32 may be integral (i.e., single piece construction) with the other components of the bin 20. Alternatively, the separation module 32 is detachably connected to the bin 20 via a feed module 45 (described in greater detail below). With this configuration, the separation module 32 can be removed for maintenance or replaced without having to pull the entire bin 20 from its frame.

The separation module 32 may include a drive roller 34 and opposed idler roller 36, wherein a nip is defined between the rollers 34, 36 through which the strip of lottery tickets 14 is conveyed, as seen in FIG. 2. A first motor 40 drives the drive roller 34, for example via a gear arrangement or other suitable drive means. The motor 40 is controlled by a bin controller (not depicted), which may be provided on a circuit board within the separation module 32. Via the controller, the motor 40 is switchable between a convey mode wherein the drive roller 34 engages and conveys the leading lottery ticket 14 through the nip to a separation position (discussed below) and a brake mode wherein the motor 40 provides a reverse retarding force to the drive roller 34 thereby braking the drive roller 34 against an attempted reeling of the lottery tickets 14 from the dispensing unit 10. This retarding force does not cause the drive roller 34 to reverse direction and draw the lead ticket 14 back into to separation module 32 but is sufficient to generate a "holding effect" at the roller nip on the adjacent lottery ticket 14 to prevent reeling of the continuous strip of tickets by a person grasping the leading ticket 14 extending from a dispensing slot and attempting to pull additional tickets 14 from the bin 20.

The separation module 32 includes an automatic separator device 46 upstream of the drive roller 34 in a conveying direction of the lottery tickets 14 that separates the leading lottery ticket 14 from its adjacent lottery ticket. The drive roller 34 is driven to convey the leading ticket 14 to the separation position such that a line (e.g., a perforation line) between the leading ticket 14 and an adjacent ticket 14 is upstream of the drive roller 34 at a location where it is acted on by the separator device 46. An embodiment of a suitable separator device 46 is described, for example, in co-pending U.S. application Ser. No. 17/020,080 filed Oct. 14, 2020. The '080 application is incorporated herein by reference in its entirety for all purposes.

The dispensing bin 20 may include a feed module 45 operationally configured between the separation module 32 and the ticket compartment(s) 28. The feed module 45 includes a feed roller 47 and opposed idler roller 49 with a nip therebetween. The feed roller 47 is driven by a feed motor 52 (e.g., via gears) to engage and convey the continuous strip of lottery tickets 14 from the ticket compartment 28 to the separation module 32. In the embodiment depicted in the figures, the separation module 32 is detachably connected to the feed module 45.

An optical scanner 50 is disposed below or above the path of the lottery tickets 14 through the feed module 45 or separation module 32 to detect the mark on the tickets 14. The scanner 50 may be any conventional reader, such as a point scanner, linear scanner, laser scanner, LED image scanner, and so forth. The mark may be a barcode or Q-code printed on the back of each lottery ticket 14. The scanner 50 is in communication with the dispenser controller 22 via the bin's controller for various purposes, for example to control the run time of the feed motor 51 based on detection of the separation line between the leading ticket 14 and the adjacent ticket.

For purposes of the present method, by reading the marks on the individual lottery tickets 14 as they are sequentially dispensed from the bin 20 in a dispense sequence, the scanner 50 enables the controller(s) 22, 24 to keep a continuous inventory of the lottery tickets 14 remaining in the bin 20. The stack 15 of lottery tickets 14 initially loaded into the bin 20 contains a defined number of lottery tickets 14. This number is entered automatically or manually into the controller 22 (or may be provided to the controller 22 from the central lottery controller 24). The controller 22 subtracts the number of dispense sequences detected by the scanner 50 from the total number of tickets in the initial stack 15 to maintain an accurate inventory of the remaining lottery tickets 14 in the bin 20.

Figure 3:
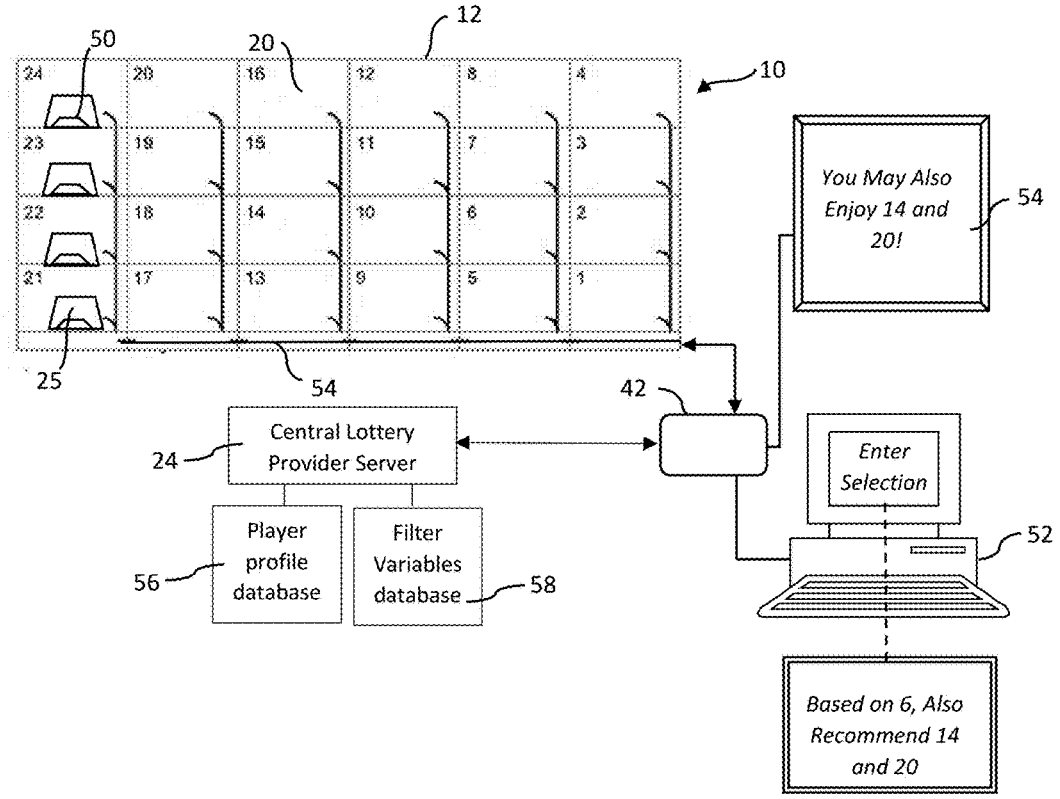
FIG. 3 is a view of an alternative automated lottery ticket dispenser configured for practice of the methods described herein.

FIG. 3 depicts an embodiment of an automated dispenser 10 configured for operation by a clerk in a retail establishment. Such dispensers 10 are typically located at a point of sale (POS) within the establishment and are configured with a dedicated terminal 52, which is in communication with the dispenser controller 42 (internal or external to the cabinet 12). The clerk enters a purchase request via the terminal 52 that is processed by the controller 42, which transmits a dispense command to one or more of the bins 20. Each of the bins 20 is configured with a dispensing mechanism 25 and scanner 50. Various operational aspects of the disperser 10 in FIG. 3 are as described above with respect to the dispenser of FIG. 2.

Figure 4:
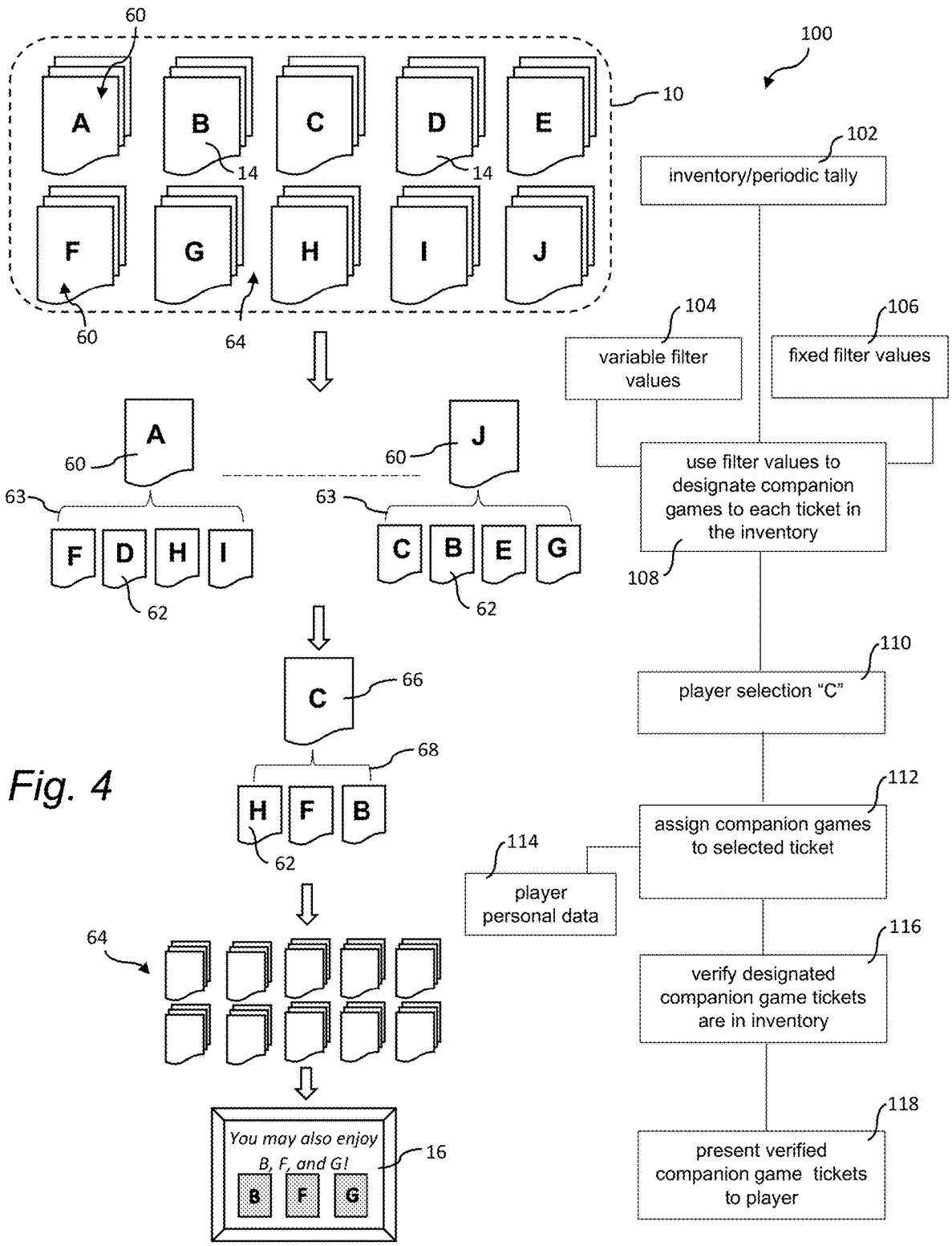
FIG. 4 depicts a method for dispensing lottery tickets in accordance with aspects of the present invention.

With reference to FIG. 4, an exemplary lottery ticket dispensing method 100 in accordance with the invention is depicted. At 102, the method includes providing an inventory 64 of the lottery tickets 14 in an automated dispenser 10, wherein the inventory includes lottery tickets 14 for a plurality of different lottery games 60 (e.g., games A through J). For example, the lottery tickets 14 may be scratch-off lottery tickets wherein each game 60 (A-J) has a different game theme (e.g., sports, music, etc.), rules of play, prize structure, and the like.

At 108, a group 63 of one or more companion lottery games 62 from the different lottery games 60 in the dispenser is designated for each of the different lottery games 60 based on one or more predefined filter values 104, 106. In FIG. 4, the designated group 63 includes four companion lottery games 62 for each lottery game 60. This step is performed by the dispenser controller 22 or the central lottery controller 24, or a combination of the two controllers 22, 24, functioning as decision engines and may be performed and predetermined prior to a player making an initial selection of a lottery ticket for purchase from the 10, for example at the initial loading of the inventory 64 into the dispenser 10, wherein identification of the designated groups 63 is stored in the dispenser controller 22. The designation of companion lottery games 62 may be updated whenever a new game 60 is added to or exchanged for another game 60 in the inventory 64.

At 110, the player makes a selection 66 of a lottery ticket 14 to purchase from the automated dispenser 10 (directly via the dispenser 10 of FIG. 2 or via a clerk with the dispenser 10 of FIG. 3). In FIG. 4, the player's selection 66 is a lottery ticket 14 from game (C) of the lottery games 60.

At 112, the method 100 (via one or a combination of the controllers 22, 24) makes an assignment 68 of one or more of the companion lottery games 62 initially designated for the lottery game 60 (game (C)) associated with the lottery ticket 14 selected by the player. For example, FIG. 4 indicates that the assignment 68 includes three of the four initially designated companion lottery games 62. The assignment 68 may include all or less than the companion lottery games 62 in the initial designation 63.

At 116, the method 100 includes verifying that the companion lottery games 62 in the assignment 68 actually have lottery tickets available in the inventory 64. This step 116 may be done in conjunction with steps 108 or 112, or may be done after step 112. For example, step 108 may be limited to designating companion games only from those games having tickets verified to be in inventory in the dispenser 10. Alternatively, step 112 may be limited to assigning one or more of the designated companion games 62 only to companion games verified to be in inventory in the dispenser 10.

This verification process may be accomplished using certain capabilities of the automated dispenser 10. For example, as discussed above, the initial number of lottery tickets 14 for each of the different lottery games 60 is known when loading the packs 15 of lottery tickets 14 into their respective dispenser bins 20. The number of dispense sequences as detected by the scanner 50 associated with each bin 20, is tallied by the controller(s) 22, 24 and subtracted from the known total (or from a previous total) to give the current inventory of tickets 14 in the bin 20 at any given time.

At step 118, the method 100 includes presenting the assigned (and verified) companion lottery games 62 to the player prior to completion of the purchase transaction. This may be done, for example, by displaying the companion lottery games 62 on the interactive screen 18 with a suggestion or recommendation to the player to consider such games for additional purchase, as indicated in FIG. 1. In FIG. 2, the companion lottery games 62 and recommendation may be displayed to the player on a video screen 54 that is separate from the POS terminal 52. Alternatively, the companion lottery games 62 may be presented to the clerk via the POS terminal 52 with instructions to recommend such games to the player for additional purchase.

Embodiments of the method 100 may further include conducting an inventory tally of the lottery tickets 14 for each of the different lottery games 60 continuously or according to a defined schedule in the manner described above and changing the designation 63 of companion lottery games 62 based on the inventory tally. For example, the designation 63 of companion lottery games 62 may be revised upon determination that no tickets remain in the inventory 64 for one or more of the games 60.

The method 100 may include revising the designation 63 of companion lottery games 62 when one or more of the lottery games 60 in the inventory 64 is replaced with a different lottery game 60 or when an additional lottery game 60 is added to the inventory 64 in the dispenser 10.

Figure 5:
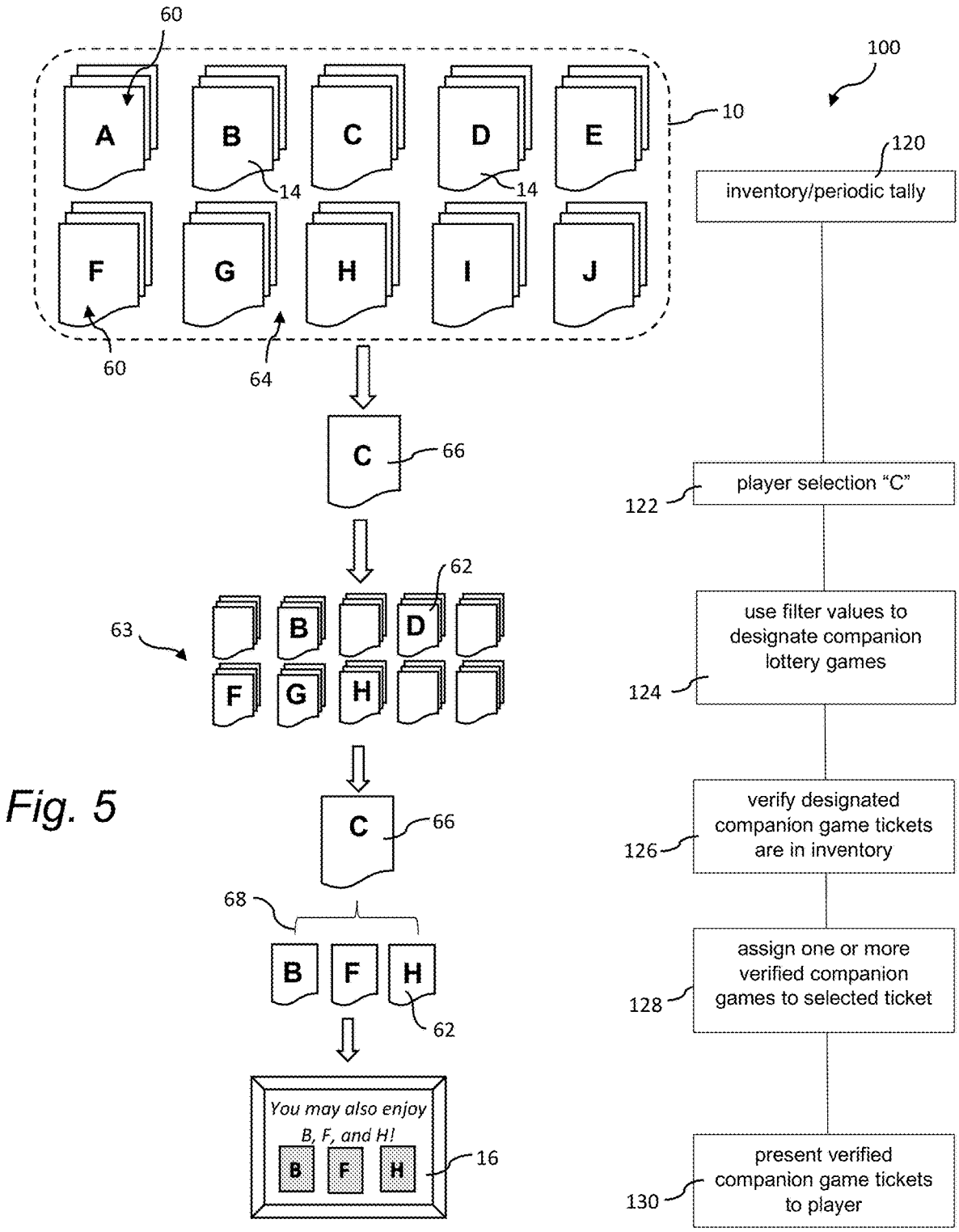
FIG. 5 depicts an alternative method for dispensing lottery tickets in accordance with aspects of the present invention.

FIG. 5 depicts another embodiment of the method 100 that is similar to the embodiment of FIG. 4 except that the designation 63 of the companion lottery games 62 is not predefined for every lottery ticket in the dispenser (as in FIG. 4) but is done at the time of the player's selection of a particular lottery ticket 66 for purchase.

Referring to FIG. 5, at step 120, the method 100 method includes providing an inventory 64 of lottery tickets 14 for each lottery game 60 in the automated dispenser 10.

At step 122, the method 100 receives the player selection for purchase of one or more tickets for a particular lottery game 60 (e.g., game (C)). The player may input this selection via the interactive screen 18 (FIG. 1) or by making a request to the retail clerk who then enters the order via the POS terminal 52 (FIG. 3).

At step 124, the filter values are used to designate one or more companion lottery games 62 to the player's selected ticket. In this case, the designation 63 includes five companion lottery games 62 (games B, D, F, G, and H). The designation 63 may be limited to only games 60 having tickets in inventory in the dispenser 10.

At step 126, a verification process is conducted to determine if game tickets are in inventory in the dispenser 10 for the designated companion lottery games 62.

At step 128, one or more of the designated (and verified) companion lottery games 62 is assigned 68 to the player's selected game ticket 66. In this case, three of the five designated companion games 62 are assigned to the game ticket 66 via the assignment 68.

The assigned companion games 62 are presented to the player with a recommendation/suggestion for purchase at step 130.

Still referring to FIG. 5, in still another embodiment, steps 124, 126, and 128 can be conducted essentially at the same time. For example, once the player makes their selection at step 122, the filter values may be applied to designate a first companion game 62. The method may then verify if this first companion game 62 has tickets in inventory. If not, the process repeats and keeps repeating until the desired number (in this case three) companion games 62 verified as having tickets in inventory are determined and assigned to the player's selected game ticket 66. The order of selection of the companion games 62 may be based on a hierarchy of points or credits assigned to the games 60 based on the filter values. In one example, when a player makes an initial lottery ticket selection 66, that selection is evaluated against all of the filter values at that point in time. The other games 60 that are available as potential companion lottery games earn "points" or credit for every filter value that applies at that moment. A decision tree implemented by the controller(s) 22, 24 then designates the potential companion lottery games 62 based on a descending points order, skipping any games 60 not having tickets in inventory in the dispenser 10, until the desired number of companion lottery games 62 can be made.

The predefined filter values used by the controller(s) 22, 24 may be one or a combination of fixed filter values 106 that are based at least in part on predetermined commonalities or relationships between the different lottery games 60 or variable filter values 104 that change based on external real-world situational data.

For example, for the fixed filter values 106, certain of the lottery games 60 may share a common theme, such as a sports theme, a card-game theme, a movie theme, a music theme, and so forth. In other embodiments, the commonality may include a certain prize structure or price of each game play. For example, lottery games 60 having a greater prize value (and thus greater purchase price) may be assigned as companion lottery games 62 for each other.

The variable filter values 104 may be based on real-world conditions or events. For example, such variable filter values 104 may related to the time of year or seasons (e.g., a holiday season), current events, geographic location of the dispenser (e.g., local sports teams), and so forth. If used, these variable filter values 104 may be periodically changed. A weighting method may be used by the controller(s) 22, 24 when assigning the companion lottery games 62 wherein more or less consideration is given to the variable filter values 104 as compared to the fixed filter values 106.

The filter values 104, 106 may be stored in an electronic database 58 (FIGS. 1 and 3) that is accessed by the controller(s) 22, 24 upon loading the lottery ticket packs 15 for the different lottery games 60 into the dispenser 10 and then used generate the assignments 63 of the respective companion lottery games 62. The filter values 104, 106 are essentially factors used by the controller(s) 22, 24 to group certain of the games 60 together based on a commonality or relationship shared by the games (the fixed filter values) or related to an external real-world variable (the variable values).

Still referring the embodiment of FIG. 4, in a particular embodiment, the method 100 may further include at step 114 inputting personal data related to the player when designating the companion lottery games 62. This personal data may include, for example, the player's age, hobbies, favorite sport teams, favorite movies/music/books, history of prior lottery ticket purchases, or virtually any type of personal information that may influence the player's selection of a lottery game 60. The personal data related to the player may be stored in an electronic player profile 56 (FIGS. 1 and 3) that is accessed upon the player inputting an identification number, password, or code (inclusive of any type of identification data) into the automated dispenser 10, for example via an interactive screen, display, keyboard, and the like.

The player's personal data may be used to further define or narrow the companion lottery games 60 in the designation 68 presented to the player. For example, in FIG. 4, four different lottery games 60 may be initially assigned as companion lottery games 62 for a particular game 60, wherein the player personal data is used to narrow this assignment 63 group to three designated companion lottery games 62.

Figure 6:
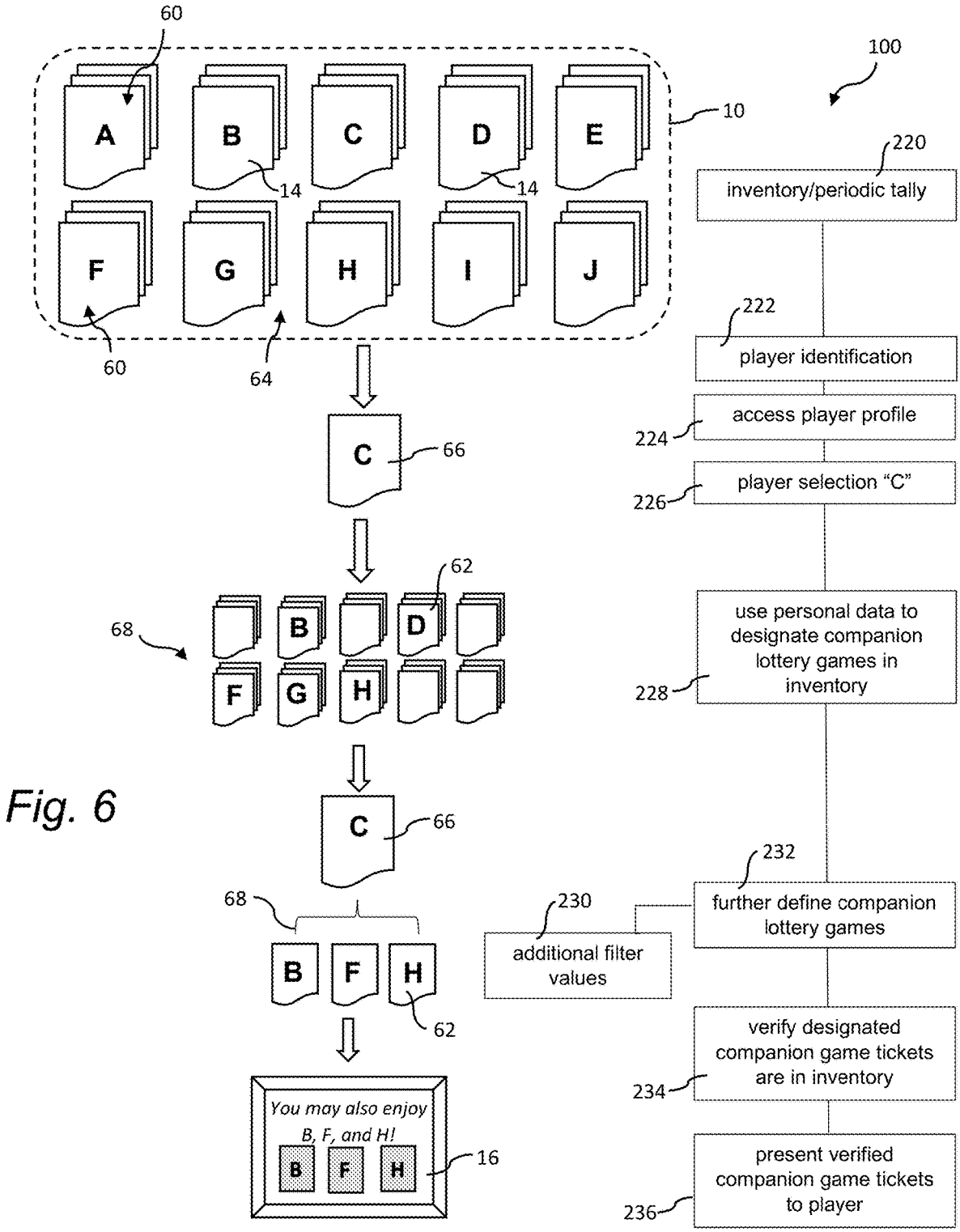
FIG. 6 depicts yet another method for dispensing lottery tickets in accordance with aspects of the present invention.

FIG. 6 depicts a method 100 wherein the player personal data is the initial means for designating the companion lottery games 62. At step 220, the method 100 method includes providing an inventory 64 of lottery tickets 14 for each lottery game 60 in the automated dispenser 10.

At step 222, the method 100 receives a player identification input in the form of a code, password, or other electronic identification means input via, for example, an interactive screen, display, keyboard, and the like.

At step 224, the method 100 accesses stored electronic personal data of the player. As discussed above, the personal data of the player may include, for example, any combination of the player's age, biometric information, hobbies, favorite sport teams, favorite movies/music/books, past ticket purchases, history or prior lottery ticket purchases, or virtually any type of personal information that may influence the player's selection of a lottery game 60. The personal data related to the player may be stored in an electronic player profile database 56.

At step 226, the method 100 receives the player selection for purchase of one or more tickets for a particular lottery game 60 (e.g., game (C)). The player may input this selection via the interactive screen 18 (FIG. 1) or by making a request to the retail clerk who then enters the order via the POS terminal 52 (FIG. 3).

At step 228, with the controller(s) 22, 24, the personal data of the player is used to make a designation 68 of one or more companion lottery games 62 from the different lottery games 60 in the inventory 64. This designation 68 may be limited to only games 60 having tickets in inventory in the dispenser 10.

At step 232, the method 100 may include inputting additional predefined filter values 230 into determination of the designated companion lottery games 62 to be presented to the player. As discussed above, these predefined filter values 230 may be one or a combination of fixed filter values based on predetermined commonalities or relationships between the different lottery games 60 in the inventory or variable filter values based on real-world external situational data. In the depicted embodiment, the designation 68 of four companion lottery games 62 is narrowed to three companion lottery games 62 with consideration of one or more of the additional filter values 130.

At step 234, the method 100 verifies that the designated companion lottery games 62 have lottery tickets 14 available in the inventory. As discussed above, this verification may be done in conjunction with the initial designation process 68 at step 228.

At step 236, one or more of the verified, designated companion lottery games 62 are assigned to the player's selection 66 and presented to the player as a suggestion for an additional lottery ticket purchase, as discussed above with reference to the method 100 of FIGS. 4 and 5. The player can add the additional purchase to the purchase process used for their initial ticket selection, which is processed by the dispenser controller 22, 42.

The present invention also encompasses a lottery ticket dispensing system configured for execution of the method embodiments discussed above. Embodiments of such system are depicted in the figures and described above.

The embodiments particularly shown and described above are not meant to be limiting, but instead serve to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispensing method, comprising:

providing an inventory of lottery tickets in a dispenser, the inventory comprising lottery tickets for a plurality of different lottery games;

upon a player making a selection of a lottery ticket from the dispenser, with a controller in communication with the dispenser, assigning one or more companion lottery games for the lottery ticket selected by the player from the different lottery games in the inventory based on predefined filter values;

verifying that the assigned companion lottery games have lottery tickets available in the inventory; and presenting one or more of the verified designated companion lottery games to the player as a suggestion or recommendation for an additional lottery ticket purchase.

2. The lottery ticket dispensing method as in claim 1, wherein a designation of the companion lottery games to the lottery tickets in the dispenser is done prior to the player's selection, the assignment of companion lottery games made from the designated companion lottery games.

3. The lottery ticket dispensing method as in claim 1, wherein a designation of the companion lottery games to the lottery tickets in the dispenser is done at a time of the player's selection.

4. The lottery ticket dispensing method as in claim 1, wherein the dispenser is an automated self-serve dispenser operated by the player for purchase of lottery tickets or an automated dispenser operated by a clerk upon request by the player for purchase of lottery tickets.

5. The lottery ticket dispensing method as in claim 1, further comprising conducting a continuous or periodic inventory tally of the lottery tickets in the dispenser for each of the different lottery games, wherein the verifying step comprises checking the designated companion lottery games against the inventory tally.

6. The lottery ticket dispensing method as in claim 5, wherein designation of the companion lottery games is limited to games having lottery tickets in the dispenser according to the inventory tally.

7. The lottery ticket dispensing method as in claim 5, wherein designation of a first one of the companion lottery games is made and then checked against the inventory tally, the designation process repeating until a desired number of the companion lottery tickets have been verified as having available lottery tickets in the dispenser.

8. The lottery ticket dispensing method as in claim 1, wherein the predefined filter values are one or a combination of fixed filter values based on predetermined commonalities between the different lottery games in the inventory or variable filter values based on external situational data.

9. The lottery ticket dispensing method as in claim 8, wherein the predefined filter values are stored in a database that is accessed upon loading the lottery tickets for the different lottery games into the dispenser.

10. The lottery ticket dispensing method as in claim 9, wherein the variable filter values are periodically changed.

11. The lottery ticket dispensing method as in claim 1, further comprising using personal data related to the player when designating the companion lottery games.

12. The lottery ticket dispensing method as in claim 11, wherein the personal data is stored in a remote electronic player profile database that is accessed upon the player inputting an identification number or code into the automated dispenser.

13. A lottery ticket dispensing method, comprising:

providing an inventory of lottery tickets in a dispenser, the inventory comprising lottery tickets for a plurality of different lottery games;

upon identification of a player, with a controller in communication with the dispenser, accessing stored electronic personal data of the player;

with the controller, using the personal data of the player to designate one or more companion lottery games from the different lottery games in the inventory;

verifying that the designated companion lottery games have lottery tickets available in the inventory; and presenting one or more of the verified designated companion lottery games to the player as a suggestion for an additional lottery ticket purchase.

14. The lottery ticket dispensing method as in claim 13, wherein the personal data is stored in an electronic player profile that is accessed upon the player inputting an identification number or code into the automated dispenser.

15. The lottery ticket dispensing method as in claim 13, further comprising conducting a continuous or periodic inventory tally of the lottery tickets in the dispenser for each of the different lottery games, wherein the verifying step comprises checking the designated companion lottery games against the inventory tally.

16. The lottery ticket dispensing method as in claim 15, wherein the designation of the companion lottery games is limited to games having lottery tickets in the dispenser according to the inventory tally.

17. The lottery ticket dispensing method as in claim 15, wherein designation of a first one of the companion lottery games is made and then checked against the inventory tally, the designation process repeating until a desired number of the companion lottery tickets have been verified as having available lottery tickets in the dispenser.

18. The lottery ticket dispensing method as in claim 13, wherein the automated dispenser is one of a self-serve dispenser operated by the player for purchase of lottery tickets or is operated by a clerk upon request by the player for purchase of lottery tickets.

19. The lottery ticket dispensing method as in claim 13, further comprising inputting additional predefined filter values into the determination of the designated companion lottery games presented to the player, wherein the predefined filter values are one or a combination of fixed filter values based on predetermined commonalities between the different lottery games in the inventory or variable filter values based on external situational data.

* * * * *